US008777358B2

(12) United States Patent
Nakamura

(10) Patent No.: US 8,777,358 B2
(45) Date of Patent: Jul. 15, 2014

(54) INKJET PRINTER

(71) Applicant: Riso Kagaku Corporation, Tokyo (JP)

(72) Inventor: Hiroyuki Nakamura, Ibaraki (JP)

(73) Assignee: Riso Kagaku Corporation, Minato-Ku, Tokyo (JP)

( * ) Notice: Subject to any disclaimer, the term of this patent is extended or adjusted under 35 U.S.C. 154(b) by 0 days.

(21) Appl. No.: 13/922,556

(22) Filed: Jun. 20, 2013

(65) Prior Publication Data

US 2013/0342598 A1 Dec. 26, 2013

(30) Foreign Application Priority Data

Jun. 25, 2012 (JP) ..... 2012-141911

(51) Int. Cl.
*B41J 29/38* (2006.01)

(52) U.S. Cl.
USPC ..... 347/14; 347/13; 347/42

(58) Field of Classification Search
USPC ..... 347/13, 14
See application file for complete search history.

(56) References Cited

U.S. PATENT DOCUMENTS 8,308,261 B2 * 11/2012 Aruga ..... 347/13
2012/0026227 A1 * 2/2012 Tanaka et al. ..... 347/9

FOREIGN PATENT DOCUMENTS

JP 2011-143712 A 7/2011

* cited by examiner

*Primary Examiner* — Julian Huffman
(74) *Attorney, Agent, or Firm* — Nath, Goldberg & Meyer; Jerald L. Meyer; Stanley N. Protigal

(57) ABSTRACT

In an inkjet head, at least one of a plurality of nozzle arrays to eject ink of different colors from one another is arranged with nozzles displaced in position from nozzles of the other nozzle arrays in an arrangement direction of the nozzles. A controller is configured to reduce an amount of ink to be ejected to a pixel at an end portion of an image on one side in the arrangement direction from a nozzle array of the plurality of nozzle arrays having a nozzle protruding to the one side the most among the nozzles of the nozzle arrays for a same ejection target pixel.

5 Claims, 9 Drawing Sheets

INKJET PRINTER

CROSS REFERENCE TO RELATED APPLICATION

This application is based upon and claims the benefit of priority from the prior Japanese Patent Application No. 2012-141911, filed on Jun. 25, 2012, the entire contents of which are incorporated herein by reference.

BACKGROUND

1. Technical Field

The present invention relates to an inkjet printer configured to print on a print medium through ejection of ink from an inkjet head.

2. Related Art

Japanese Patent Application Publication No. 2011-143712 proposes an inkjet printer having a line inkjet head formed by multiple head blocks.

In order to aim, for example, reduction in man-hours for attaching head blocks, some inkjet color printers use head blocks each formed by assembling multiple head modules having nozzle arrays capable of ejecting ink of different colors from one another.

SUMMARY

Such an inkjet color printer ejects different colors of ink to each line of a print target image from the nozzles arrays sequentially from the most upstream one. Thereby, an image of a secondary color obtained by superimposing multiple colors of ink is printed.

In the above-described head block formed by assembling multiple head modules, in some cases, the nozzles of adjacent ones of the head modules (nozzle arrays) are displaced in position from each other in an arrangement direction of the nozzles (i.e., a main scanning direction).

When ink is ejected from the nozzle arrays of such a head block, ink dots of respective colors formed on the print medium are displaced in position from each other in the main scanning direction. Even with such a dot displacement, a portion other than end portions of the image in the main scanning direction is less likely to have a color-tone change owing to superimposition with an adjacent dot, or can be corrected in color tone by using an image profile. However, for the end portions of the image in the main scanning direction, the color of ink ejected from a nozzle protruding in the main scanning direction is emphasized in its tone in the printed image. This lowers the quality of the printed image.

The present invention aims to provide an inkjet printer capable of alleviating lowering of the quality of a printed image.

An inkjet printer in accordance with some embodiments includes an inkjet head having a plurality of nozzle arrays each having a plurality of nozzles configured to eject ink, the nozzle arrays being configured to eject ink of different colors from one another, and a controller configured to control the inkjet head. At least one of the plurality of nozzle arrays is arranged with the nozzles thereof displaced in position from the nozzles of the other nozzle arrays in an arrangement direction of the nozzles. The controller is configured to reduce an amount of ink to be ejected to a pixel at an end portion of an image on one side in the arrangement direction from a nozzle array of the plurality of nozzle arrays having a nozzle protruding to the one side the most among the nozzles of the nozzle arrays for a same ejection target pixel. The controller is configured to reduce an amount of ink to be ejected to a pixel at an end portion of the image on the other side in the arrangement direction from a nozzle array of the plurality of nozzle arrays having a nozzle protruding to the other side the most among the nozzles of the nozzle arrays for a same ejection target pixel.

According to the above configuration, when the nozzles in the respective nozzle arrays for one and the same ejection target pixel eject ink to a pixel at an end portion of an image on one side in the arrangement direction, the controller reduces an amount of ink ejected from the nozzle array that has the nozzle protruding to the one side the most among the nozzles in the respective nozzle arrays, and when the nozzles in the respective nozzle arrays for one and the same ejection target pixel eject ink to a pixel at an end portion of an image on the other side in the arrangement direction, the controller reduces an amount of ink ejected from the nozzle array that has the nozzle protruding to the other side the most among the nozzles in the respective nozzle arrays. Thereby, a change in color tone at the end portions of the image can be suppressed. As a result, lowering of the quality of printed image can be alleviated.

The controller may be configured to control a level of reduction in the amount of ink to be ejected, according to an original amount of ink to be ejected, before the reduction, to a pixel targeted for the reduction in the amount of ink to be ejected.

According to the above configuration, the controller controls the level of the reduction in the amount of ink ejected, according to the original amount of ink to be ejected, before the reduction, to the pixel targeted for the reduction in the amount of ink ejected. By thus making the level of the reduction be in accordance with the amount of ink ejected, it can be suppressed that an excessive change is made on the printed image.

The controller may be configured to control a level of reduction in the amount of ink to be ejected to the pixel at the end portion of the image on the one side, according to a length by which the nozzle array of the plurality of nozzle arrays having the nozzle protruding to the one side the most among the nozzles of the nozzle arrays for the same ejection target pixel is displaced from a nozzle array of the plurality of nozzle arrays having the second-most protruding nozzle. The controller may be configured to control a level of reduction in the amount of ink to be ejected to the pixel at the end portion of the image on the other side, according to a length by which the nozzle array of the plurality of nozzle arrays having the nozzle protruding to the other side the most among the nozzles of the nozzle arrays for the same ejection target pixel is displaced from a nozzle array of the plurality of nozzle arrays having the second-most protruding nozzle.

According to the above configuration, the controller controls the level of the reduction in the amount of ink ejected, according to a length by which the nozzle array having the nozzle protruding to the one side or the other side the most among the nozzles in the nozzle arrays for one and the same ejection target pixel is displaced from the nozzle array having the second-most protruding nozzle. Thereby, the level of the reduction in the amount of ink ejected can be adjusted appropriately according to the positional relation among the nozzle arrays.

The controller may be configured to control the amount of ink to be ejected, according to a color of the pixel at the end portion of the image on each of the one side and the other side.

According to the above configuration, the controller controls the amount of ink ejected, according to a color of the pixel at the end portion of the image. Thereby, the processing can be simplified.

An inkjet printer in accordance with some embodiments includes an inkjet head having a plurality of nozzle arrays each having a plurality of nozzles configured to eject ink, the nozzle arrays being configured to eject ink of different colors from one another, and a controller configured to control the inkjet head. At least one of the plurality of nozzle arrays is arranged with the nozzles thereof displaced in position from the nozzles of the other nozzle arrays in an arrangement direction of the nozzles. The controller is configured to increase an amount of ink to be ejected to a pixel at an end portion of an image on one side in the arrangement direction from nozzle arrays of the plurality of nozzle arrays other than a nozzle array having a nozzle protruding to the one side the most among the nozzles of the nozzle arrays for a same ejection target pixel. The controller is configured to increase an amount of ink to be ejected to a pixel at an end portion of the image on the other side in the arrangement direction from nozzle arrays of the plurality of nozzle arrays other than a nozzle array having a nozzle protruding to the other side the most among the nozzles of the nozzle arrays for a same ejection target pixel.

According to the above configuration, a change in color tone at the end portions of the image can be suppressed. As a result, lowering of the quality of printed image can be alleviated.

DETAILED DESCRIPTION

Figure 1:
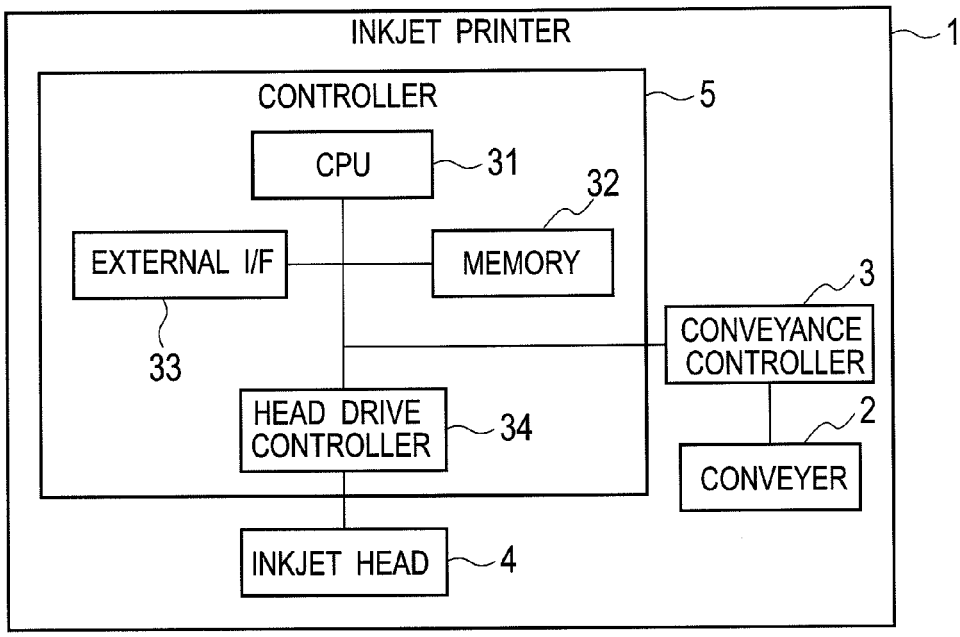
FIG. 1 is a block diagram showing the configuration of an inkjet printer according to an embodiment.

With reference to the drawings, an embodiment of the present invention is described below. Throughout the drawings, the same or like portions or elements are denoted by the same or like reference numerals. In addition, it should be noted that the drawings are only schematic and ratios of dimensions and the like are different from actual ones. Moreover, the drawings naturally include portions having different dimensional relationships and ratios from each other.

The embodiment is given below only to provide an example of a machine and the like for embodying a technical concept of the present invention, and the technical concept of the present invention does not limit the arrangement of elements and the like to what is described below. The technical concept of the present invention can be variously changed without departing from the scope of claims.

Figure 2:
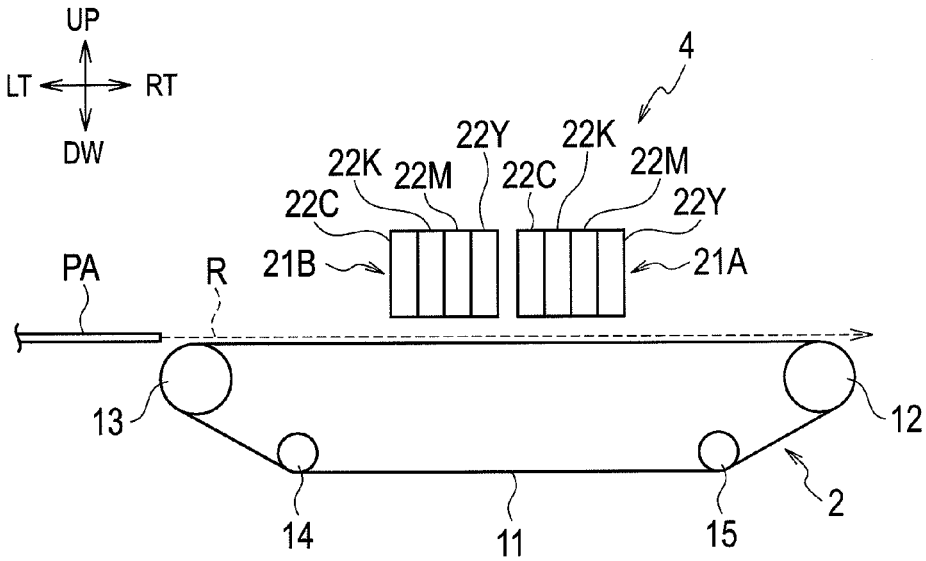
FIG. 2 is a diagram schematically showing the configuration of a conveyer and an inkjet head.
Figure 3:
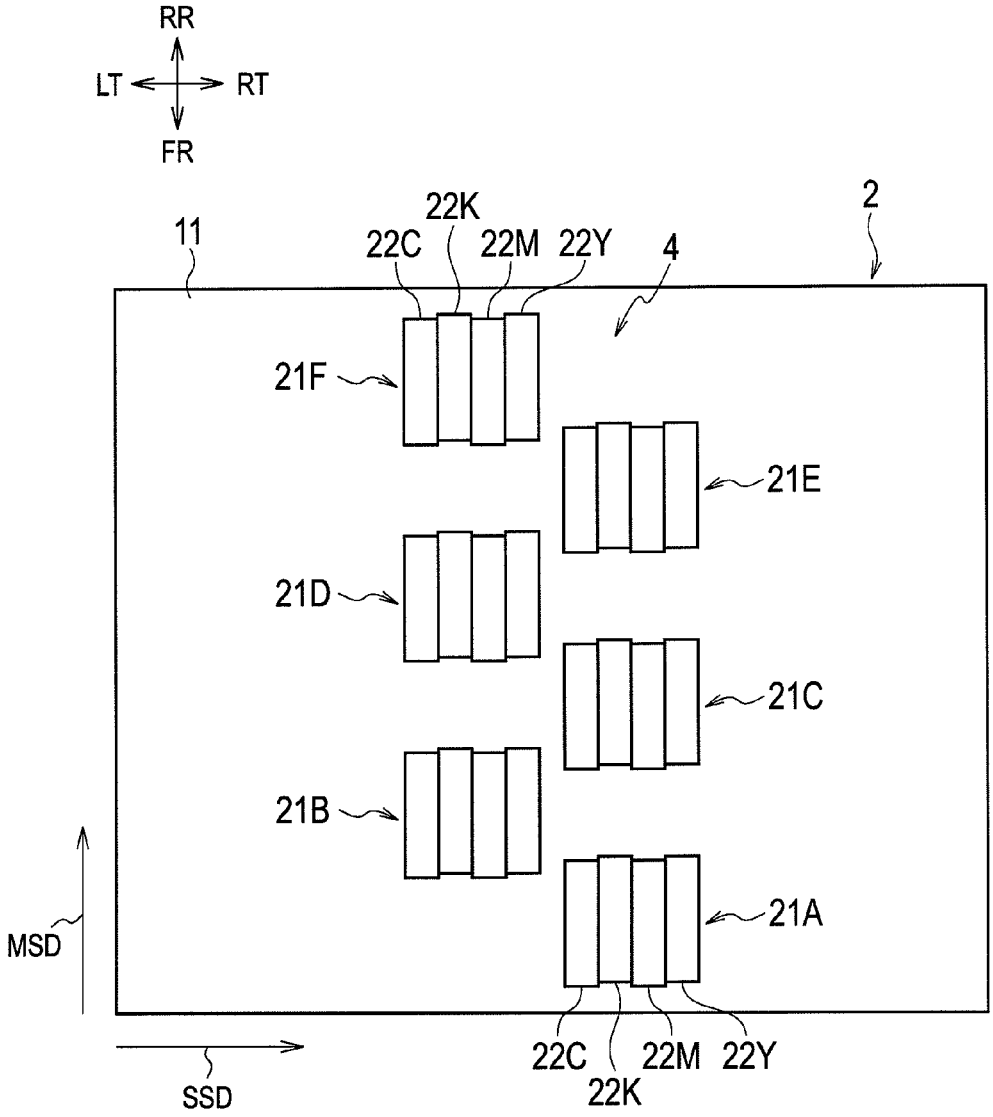
FIG. 3 is a plan view of the conveyer and the inkjet head.

FIG. 1 is a block diagram showing the configuration of an inkjet printer according to the embodiment of the present invention. FIG. 2 is a diagram schematically showing the configuration of a conveyer and an inkjet head of the inkjet printer shown in FIG. 1. FIG. 3 is a plan view of the conveyer and the inkjet head.

In the following description, a direction orthogonal to the plane of FIG. 2 is a front direction and a rear direction, where a direction from the front side of the plane is a front. Further, as shown in FIG. 2, up, down, left, and right seen from the front is an up direction, a down direction, a left direction, and a right direction, and they are denoted in the drawings as UP, DW, LT, and RT, respectively. The front direction and the rear direction are orthogonal to the up, down, left, and right directions as shown in FIG. 3 and so on, and denoted in the drawings as FR and RR, respectively. A path shown in FIG. 2 with a broken line is a conveyance path R along which a sheet PA as a print medium is conveyed, and its conveyance direction is from the left to the right. In the following description, upstream and downstream mean those in the conveyance direction.

As shown in FIG. 1, an inkjet printer 1 according to this embodiment includes a conveyer 2, a conveyance controller 3, an inkjet head 4, and a controller 5.

The conveyer 2 is configured to convey the sheet PA. As shown in FIG. 2, the conveyer 2 includes a conveyer belt 11, a driven roller 12, and follower rollers 13 to 15.

The conveyer belt 11 is an annular belt fitted over the driven roller 12 and the follower rollers 13 to 15. The conveyer belt 11 has a number of belt holes to suck and hold the sheet PA by use of sucking force generated therein by a fan (not shown). The conveyer belt 11 is rotated clockwise in FIG. 2 by the driven roller 12 being driven, and thereby conveys the sheet PA, which is sucked and held thereon, rightward.

The conveyer belt 11 is fitted over the driven roller 12 and the follower rollers 13 to 15. The driven roller 12 rotates the conveyer belt 11 by being driven by a motor (not shown). The follower rollers 13 to 15 follow the rotation of the driven roller 12 via the conveyer belt 11. The follower roller 13 is placed at a position which is at substantially the same height as the driven roller 12 and spaced away from the driven roller 12 by a predetermined distance in the left-right direction. The follower rollers 14 and 15 are placed at substantially the same height as each other below the driven roller 12 and the follower roller 13 and spaced away from each other by a predetermined distance in the left-right direction.

The conveyance controller 3 is configured to control the conveyer 2. Specifically, the conveyance controller 3 controls the fan and the motor which drives the driven roller 12.

The inkjet head 4 is configured to eject ink to the sheet PA conveyed by the conveyer 2 to print an image thereon. The inkjet head 4 is placed above the conveyer 2. The inkjet head 4 is a line inkjet head and has multiple head blocks 21A, 21B, and so on. In this embodiment, the inkjet head 4 has six head blocks 21A to 21F, as shown in FIG. 3.

The six head blocks 21A to 21F are arranged in a main scanning direction substantially orthogonal to a sub scanning direction which is the same as the conveyance direction of the sheet PA. The head blocks 21A to 21F are alternately displaced in position in the sub scanning direction. In this embodiment, when the head blocks 21A to 21F do not need to be distinguished from each other for example, they may be denoted only by reference numeral 21 without the following alphabet (A to F).

Each head block 21 has a unit of four head modules 22C, 22K, 22M, and 22Y assembled together. The head modules 22C, 22K, 22M, and 22Y are arranged in this order from the upstream side (left side). The head modules 22C, 22K, 22M, and 22Y are configured to eject ink of cyan (C), black (K), magenta (M), and yellow (Y), respectively. In this embodiment, when the head modules 22C, 22K, 22M, and 22Y do not need to be distinguished regarding their colors for example, they may be denoted without their following alphabets (C, K, M, and Y) indicating their colors.

Figure 4:
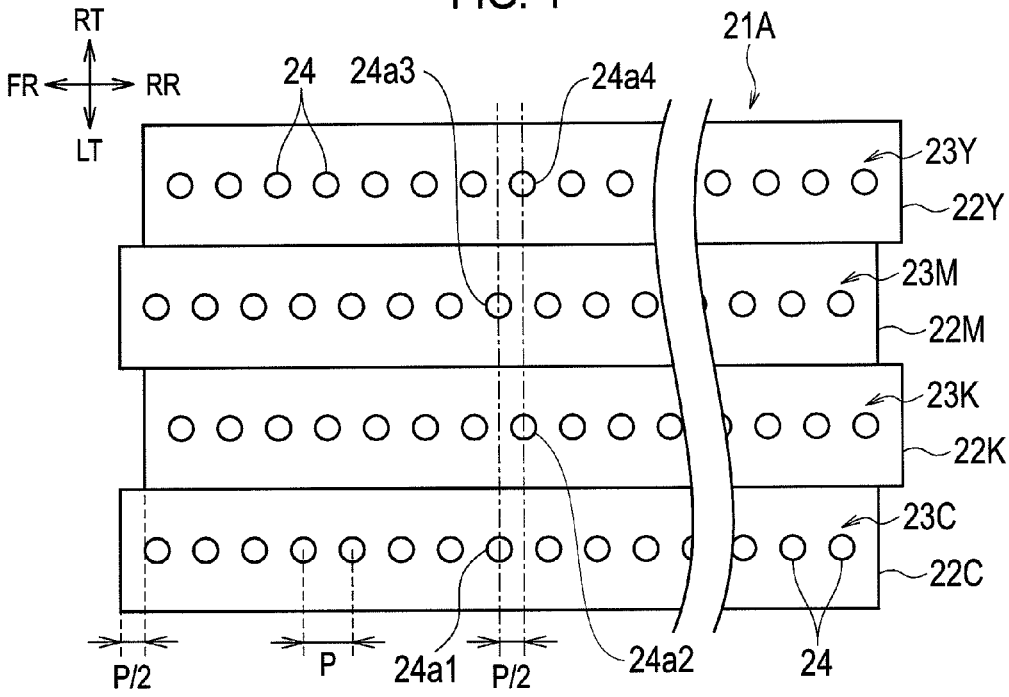
FIG. 4 is a diagram schematically showing a head block.

As shown in FIG. 4, the head modules 22C, 22K, 22M, and 22Y have nozzle arrays 23C, 23K, 23M, and 23Y at their lower surfaces, respectively. FIG. 4 shows the head block 21A from below. The nozzle arrays 23C, 23K, 23M, and 23Y are each formed by multiple nozzles 24 configured to eject ink of a corresponding one of cyan (C), black (K), magenta (M), and yellow (Y). The nozzles 24 of each nozzle array 23 are arranged in the main scanning direction (front-rear direction) at equal intervals of a predetermined pitch P.

In each head block 21, at least one of the head modules 22C, 22K, 22M, and 22Y is displaced in the main scanning direction. Accordingly, the nozzles 24 of at least one of the head modules 22C, 22K, 22M, and 22Y are displaced in position in the main scanning direction from the nozzles 24 of the other nozzle arrays 23.

Specifically, in an example shown in FIG. 4, the head modules 22K and 22Y are displaced rearward from the head modules 22C and 22M by a half pitch (P/2). In this case, among the nozzles 24 used for the same ejection target pixel, the nozzles 24 of the nozzle arrays 23C and 23M and the nozzles 24 of the nozzle arrays 23K and 23Y are displaced from each other by the half pitch. For instance, the nozzles 24 used to eject ink to the same pixel in image data are the following four nozzles: a nozzle 24*a*1 of the nozzle array 23C and a nozzle 24*a*3 of the nozzle array 23M as well as a nozzle 24*a*2 of the nozzle array 23K and a nozzle 24*a*4 of the nozzle array 23Y which are displaced rearward from the nozzles 24*a*1 and 24*a*3.

Figure 5:
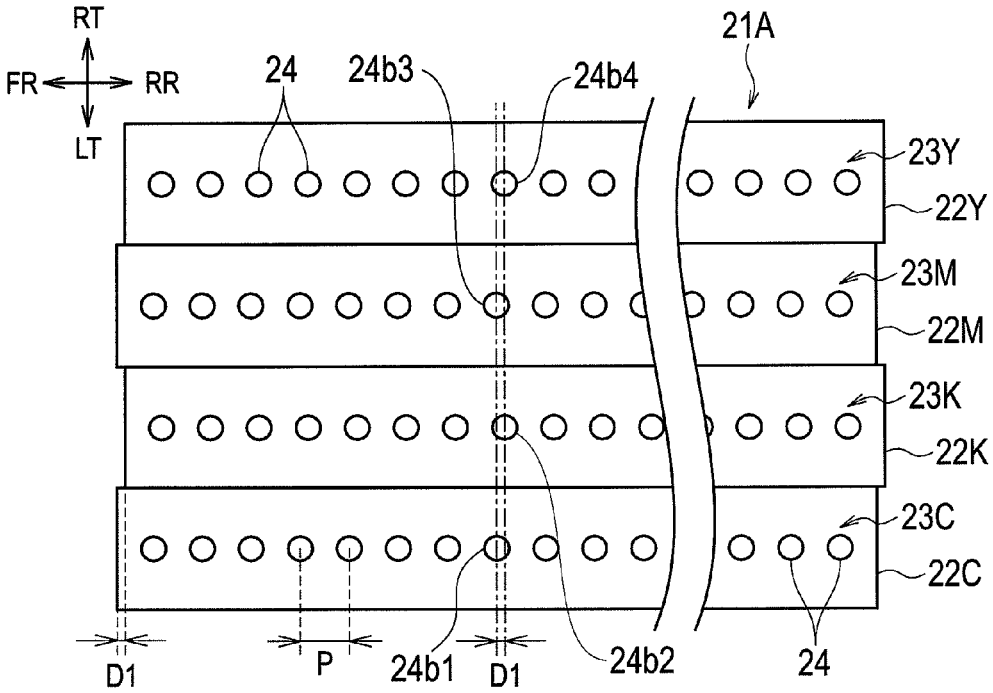
FIG. 5 is a diagram schematically showing a head block.

The length of displacement of the head modules 22 is not limited to the half pitch as in FIG. 4. For example, as shown in FIG. 5, the head modules 22K and 22Y may be displaced rearward from the head modules 22C and 22M by a displacement length D1 smaller than the half pitch (P/2). In this case, for instance, the nozzles 24 used to eject ink to the same pixel in image data are the following four nozzles: a nozzle 24*b*1 of the nozzle array 23C and a nozzle 24*b*3 of the nozzle array 23M as well as a nozzle 24*b*2 of the nozzle array 23K and a nozzle 24*b*4 of the nozzle array 23Y which are displaced rearward from the nozzles 24*b*1 and 24*b*3 by the displacement length D1.

Figure 6:
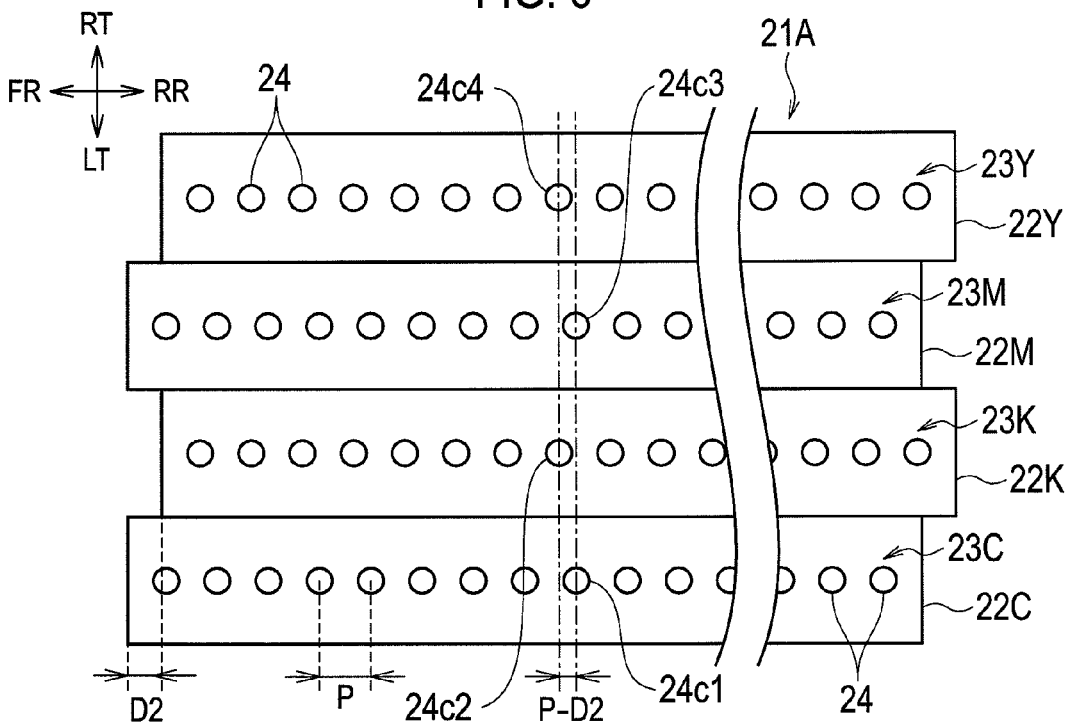
FIG. 6 is a diagram schematically showing a head block.

Alternatively, as shown in FIG. 6 as an example, the head modules 22K and 22Y may be displaced rearward from the head modules 22C and 22M by a displacement length D2 larger than the half pitch (P/2). Here, the displacement length D2 is smaller than one pitch P. In this case, for instance, the nozzles 24 used to eject ink to the same pixel in image data are the following four nozzles: a nozzle 24*c*1 of the nozzle array 23C and a nozzle 24*c*3 of the nozzle array 23M as well as a nozzle 24*c*2 of the nozzle array 23K and a nozzle 24*c*4 of the nozzle array 23Y which are displaced frontward from the nozzles 24*c*1 and 24*c*3 by (P−D2). This is because the nozzles 24 of the nozzle arrays 23 close to each other in the main scanning direction are to be used for ejection for the same pixel. For this reason, the direction of the displacement of the nozzles 24 used for the same ejection target pixel is opposite from that of the displacement of the head modules 22.

Figure 7:
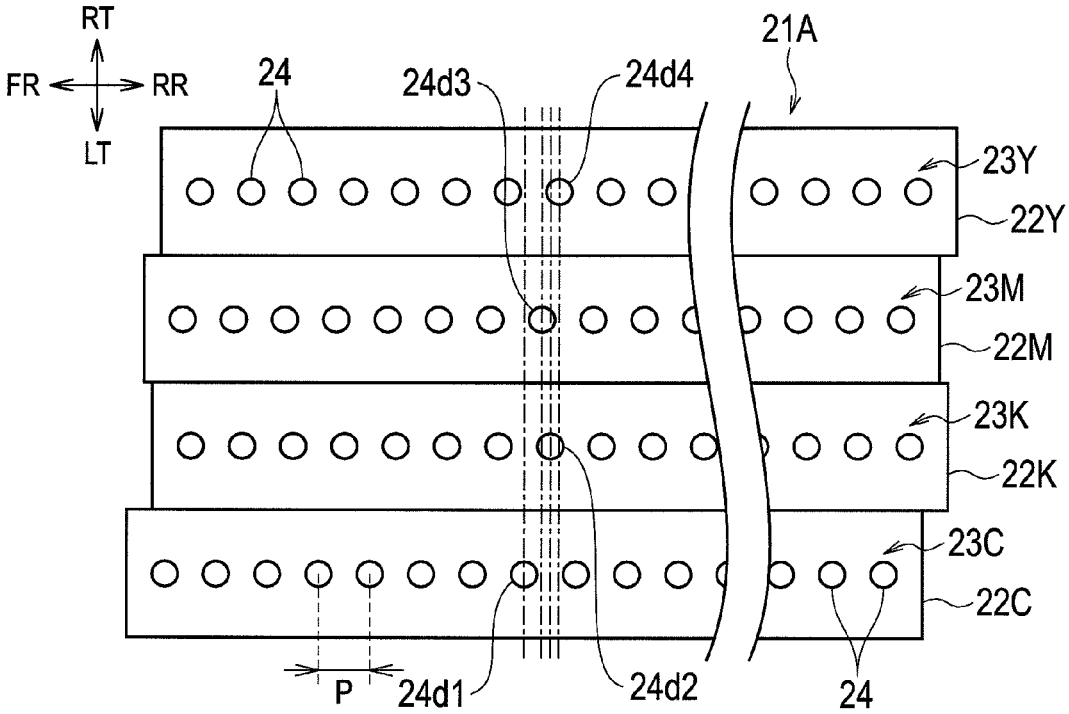
FIG. 7 is a diagram schematically showing a head block.

Moreover, as shown in FIG. 7 as an example, each of the head modules 22 may be displaced from all of the other head modules 22 in the main scanning direction. In this case, for instance, the nozzles 24 used to eject ink to the same pixel in image data are the following four nozzles: a nozzle 24*d*1 of the nozzle array 23C, a nozzle 24*d*2 of the nozzle array 23K, a nozzle 24*d*3 of the nozzle array 23M, and a nozzle 24*d*4 of the nozzle array 23Y. This is because the nozzles 24 of the nozzle arrays 23 close to each other in the main scanning direction are to be used to eject ink to the same pixel.

As described above, the nozzles 24 of the nozzle arrays 23 used to eject ink to the same pixel in image data are determined according to the positional relation among the head modules 22 (the nozzle arrays 23) in the main scanning direction. Note that the positional relation among the head modules 22 in the main scanning direction may differ from one head block 21 to another.

The controller 5 is configured to control the overall operation of the inkjet printer 1. The controller 5 has a CPU 31, a memory 32, an external interface (I/F) 33, and a head drive controller 34.

The CPU 31 is configured to control the inkjet printer 1 comprehensively. According to the positional relation among the head modules 22 (the nozzle arrays 23) in the main scanning direction, the CPU 31 determines, for each head block 21, the nozzles 24 of the respective nozzle arrays 23 used for the same ejection target pixel 24. The positional relation among the head modules 22 in the main scanning direction (the length of displacement among the head modules 22) are measured in advance.

The memory 32 is used to temporarily store data such as image data or used as a work area of the CPU 31 upon computation.

The external I/F 33 is an interface for performing communication with an external personal computer (PC) or the like via a network (not shown).

The head drive controller 34 is configured to drive the head modules 22 of each head block 21 of the inkjet head 4 to eject ink from their nozzles 24. The head drive controller 34 performs processing for correcting the amount of ink ejected to pixels at end portions, in the main scanning direction (the front-rear direction), of an image to be printed.

Specifically, when the nozzles 24, in the respective nozzle arrays, for one and the same ejection target pixel eject ink to a pixel at a front end portion of an image, the head drive controller 34 corrects the amount of ink ejected from the nozzle array 23 that has the nozzle 24 protruding (displaced) frontward the most among the nozzles 24 in the respective nozzle arrays 23. In addition, when the nozzles 24, in the respective nozzle arrays, for one and the same ejection target pixel eject ink to a pixel at a rear end portion of the image, the head drive controller 34 corrects the amount of ink ejected from the nozzle array 23 that has the nozzle 24 protruding (displaced) rearward the most among the nozzles 24 in the respective nozzle arrays 23.

For instance, in the example shown in FIG. 4, assume that the ejection target pixel of the nozzles 24*a*1 to 24*a*4 is a pixel at the front end portion of an image. In this case, since the nozzles 24*a*1 and 24*a*3 protrude rearward the most among the nozzles 24*a*1 to 24*a*4, the head drive controller 34 corrects the amount of ink ejected from the nozzles 24*a*1 and 24*a*3 to the pixel at the front end portion of the image.

In addition, in the example shown in FIG. 4, assume that the ejection target pixel of the nozzles 24*a*1 to 24*a*4 is a pixel at the rear end portion of an image. In this case, since the nozzles 24*a*2 and 24*a*4 protrude rearward the most among the nozzles 24*a*1 to 24*a*4, the head drive controller 34 corrects the amount of ink ejected from the nozzles 24*a*2 and 24*a*4 to the pixel at the rear end portion of the image.

Moreover, for instance, in the example shown in FIG. 6, assume that the ejection target pixel of the nozzles 24*c*1 to 24*c*4 is a pixel at a front end portion of an image. In this case, since the nozzles 24*c*2 and 24*c*4 protrude frontward the most among the nozzles 24*c*1 to 24*c*4, the head drive controller 34 corrects the amount of ink ejected by the nozzles 24*c*2 and 24*c*4 to the pixel at the front end portion of the image.

In addition, in the example shown in FIG. 6, assume that the ejection target pixel of the nozzles 24*c*1 to 24*c*4 is a pixel at a rear end portion of an image. In this case, since the nozzles 24*c*1 and 24*c*3 protrude rearward the most among the nozzles 24*c*1 to 24*c*4, the head drive controller 34 corrects the amount of ink ejected from the nozzles 24*c*1 and 24*c*3 to the pixel at the rear end portion of the image.

Moreover, for instance, in the example shown in FIG. 7, assume that the ejection target pixel of the nozzles 24*d*1 to 24*d*4 is a pixel at a front end portion of an image. In this case, since the nozzle 24*d*1 protrudes frontward the most among the nozzles 24*d*1 to 24*d*4, the head drive controller 34 corrects the amount of ink ejected from the nozzle 24*d*1 to the pixel at the front end portion of the image.

In addition, in the example shown in FIG. 7, assume that the ejection target pixel of the nozzles 24*d*1 to 24*d*4 is a pixel at a rear end portion of an image. In this case, since the nozzles 24*d*4 protrudes rearward the most among the nozzles 24*d*1 to 24*d*4, the head drive controller 34 corrects the amount of ink ejected from the nozzle 24*d*4 to the pixel at the rear end portion of the image.

Figure 8:
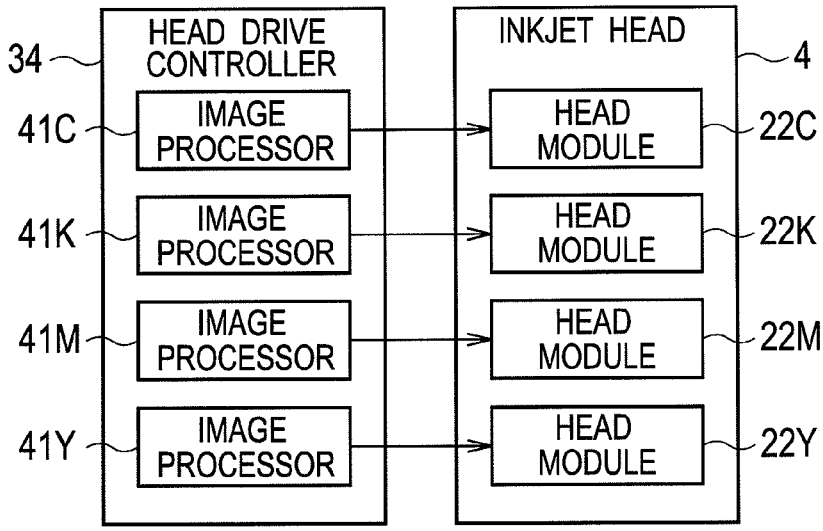
FIG. 8 is a block diagram showing the configuration of a head drive controller.

As shown in FIG. 8, the head drive controller 34 includes image processors 41C, 41K, 41M, and 41Y whose processing target colors are cyan (C), black (K), magenta (M), and yellow (Y), respectively.

Each image processor 41 is configured to perform processing for correcting the amount of ink of its processing target color ejected to a pixel at each of end portions, in the main scanning direction (the front-rear direction), of an image.

Figure 9:
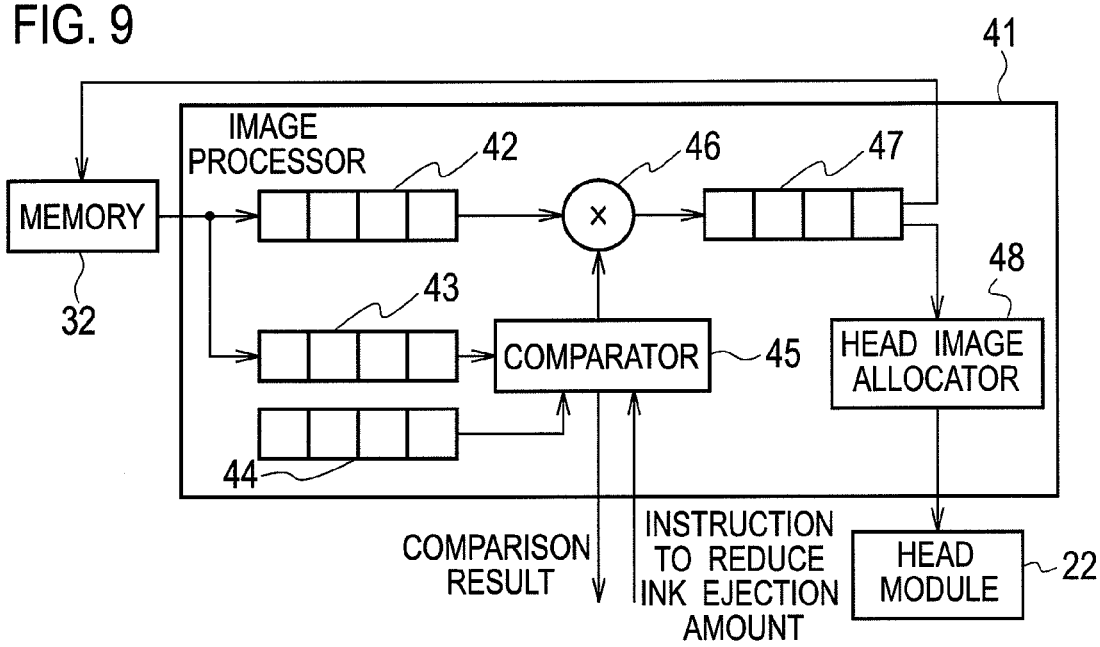
FIG. 9 is a block diagram showing the configuration of an image processor.

As shown in FIG. 9, the image processor 41 includes a data buffer 42, a shift register 43, a pattern retainer 44, a comparator 45, a multiplier 46, a corrected-data buffer 47, and a head image allocator 48.

The data buffer 42 is configured to store image data of a processing target color retrieved from the memory 32, the image data containing a predetermined number of pixels successive in the main scanning direction. The image data shows the number of ink drops for each pixel. In this embodiment, the number of drops of one color for one pixel is zero to seven. Moreover, in this embodiment, the number of pixels stored by the data buffer 42 is four. The data buffer 42 stores the four-pixel image data one after another shifted by one pixel.

The shift register 43 stores the same image data as the data buffer 42 does. The image data in the shift register 43 is used by the comparator 53 to compare the image data with an end-portion determination pattern retained by the pattern retainer 44.

The pattern retainer 44 is configured to retain end-portion determination patterns. Each end-portion determination pattern is used to determine an end portion, in the main scanning direction (the front-rear direction), of an image of the processing target color through a comparison between the end-portion determination pattern and the image data. The end portion determination patterns include a front end-portion determination pattern and a rear end-portion determination pattern.

Figure 10A:
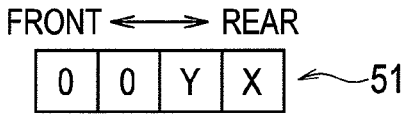
FIG. 10A is a diagram showing a front end-portion determination pattern.
Figure 10B:
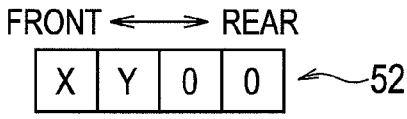
FIG. 10B is a diagram showing a rear end-portion determination pattern.

FIGS. 10A and 10B show the front end-portion determination pattern and the rear end-portion determination pattern, respectively. As shown in FIG. 10A, in a front end-portion determination pattern 51, the number of drops is zero for each of the front two pixels among the four pixels. Pixel X at a rear end and pixel Y which is the second one from the rear end both show a value which is not zero. In other words, the front end-portion determination pattern 51 is a pattern in which the number of drops is zero for the front two pixels and is not zero for the rear two pixels.

As shown in FIG. 10B, in a rear end-portion determination pattern 52, the number of drops is zero for each of the rear two pixels among the four pixels. Pixel X at a front end and pixel Y which is the second one from the front end both show a value which is not zero. In other words, the rear end-portion determination pattern 52 is a pattern in which the number of drops is zero for the rear two pixels and is not zero for the front two pixels.

Among the pixels of the image data in the data buffer 42, a pixel at a position corresponding to the position of pixel Y in each of the front end-portion determination pattern 51 and the rear end-portion determination pattern 52 is a pixel at a reduction target position and therefore might be targeted for reduction in the amount of ink ejected (the number of drops).

In the front end-portion determination pattern 51 and the rear end-portion determination pattern 52, if the value of X is zero, image data matching the end-portion determination pattern 51 or 52 is, for example, for a portion having a line of one pixel at the position of pixel Y. Since it is not appropriate to make such a portion regarded as an end portion, not only Y but also X should be a value which is not zero.

The comparator 45 is configured to compare the image data in the shift register 43 with the end-portion determination pattern retained by the pattern retainer 44. The comparator 45 outputs, to the CPU 31, a result of the comparison indicating whether or not the image data in the shift register 43 matches the end-portion determination pattern. Also, upon receipt, from the CPU 31, of an instruction to reduce the amount of ink ejected, the comparator 45 instructs the multiplier 46 to multiply the number of drops for a pixel at the reduction target position by an ejection amount reduction coefficient Kd and a nozzle positional relation coefficient Kp. The ejection amount reduction coefficient Kd and the nozzle positional relation coefficient Kp will be described later.

As instructed by the comparator 45, the multiplier 46 multiplies the number of drops for a pixel at the reduction target position by the ejection amount reduction coefficient Kd and the nozzle positional relation coefficient Kp. The multiplier 46 does not change (multiplies by one) the number of drops for pixels which are not at the reduction target position.

The corrected-data buffer 47 is configured to temporarily store the image data obtained through the computation by the multiplier 46. As will be described later, the image processor 41 first performs the correction processing for a front end portion of an image, and then performs the correction processing for a rear end portion of the image. In the correction processing for the front end portion of the image, image data temporarily stored in the corrected-data buffer 47 is sent to the memory 32. In the correction processing for the rear end portion of the image, image data temporarily stored in the corrected-data buffer 47 is sent to the head image allocator 48.

The head image allocator 48 is configured to divide the image data inputted by the corrected-data buffer 47 into appropriate pieces for the head blocks 21 and outputs them to the head blocks 21.

Next, an operation of the inkjet printer 1 is described.

Image data to be printed received from the external I/F 33 is saved in the memory 32. The image data is drop data indicating the number of drops of ink of each color for each pixel. The image data saved in the memory 32 is retrieved from the memory 32 and sent to the image processors 41 of the head drive controller 34. Then, each image processor 41 performs processing for correcting the amount of ink of its corresponding color ejected.

The processing for correcting the amount of ink ejected is described with reference to flowcharts in FIGS. 11 and 12.

Figure 11:
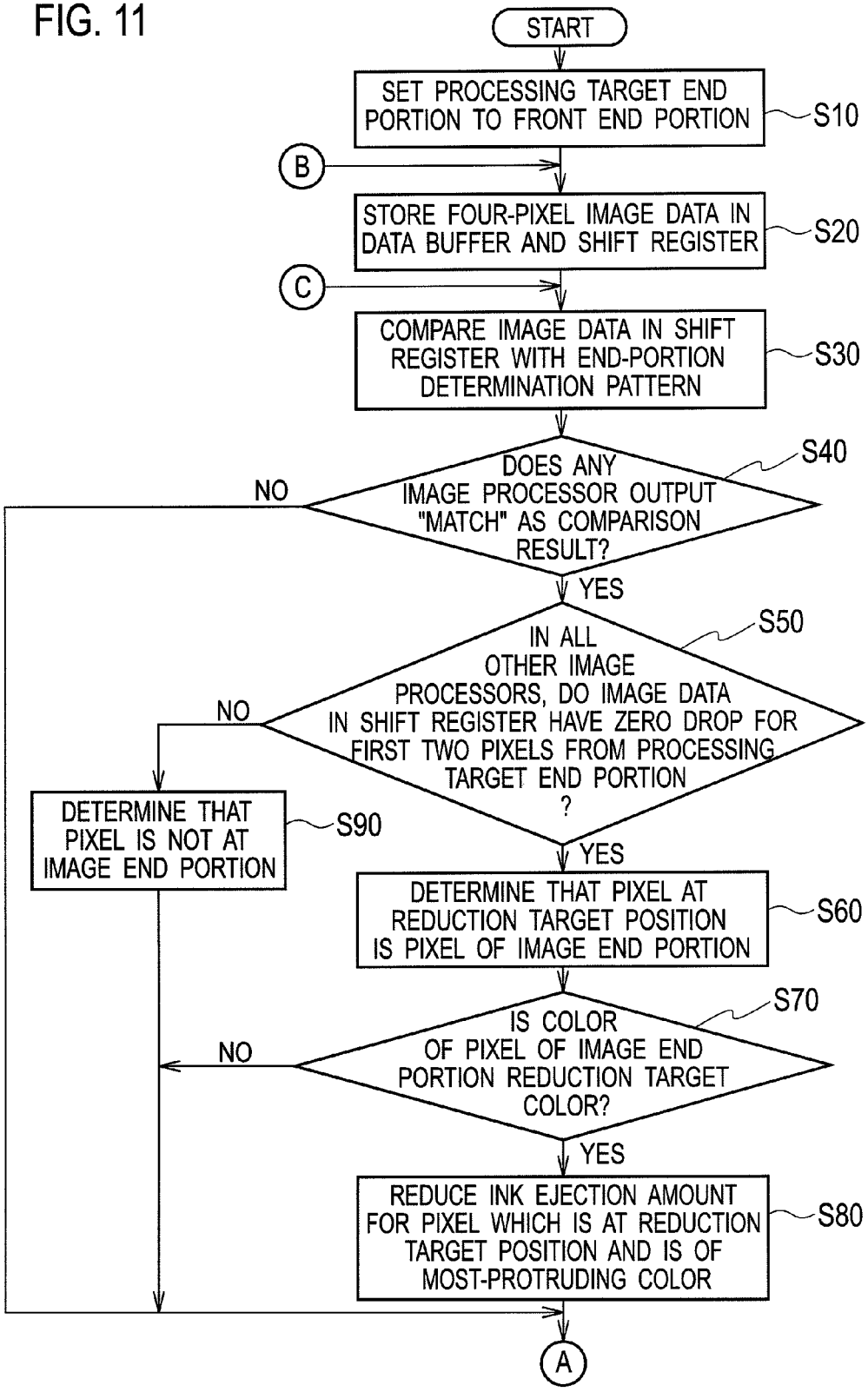
FIG. 11 is a flowchart of processing for correcting the amount of ink ejection.

In Step S10 in FIG. 11, the CPU 31 sets a front end portion as an end portion targeted for the correction processing by each image processor 41 (a processing target end portion). Thereby, the front end-portion determination pattern 51 is set in the pattern retainer 44 of each image processor 41.

Next, in Step S20, the CPU 31 acquires image data of the first four pixels from the image data saved in the memory 32, and saves the image data in the data buffer 42 and the shift register 43 of each image processor 41.

Next, in Step S30, the comparator 45 of each image processor 41 compares the image data in the shift register 43 with the end-portion determination pattern in the pattern retainer 44. The comparator 45 of each image processor 41 outputs a result of the comparison to the CPU 31 as either "MATCH" or "NO MATCH."

Next, in Step S40, the CPU 31 determines whether or not the comparison result from any of the image processors 41 is "MATCH."

When the CPU 31 determines that any of the image processors 41 shows "MATCH" as the comparison result (Step S40: YES), in Step S50, the CPU 31 determines whether or not the image data in the shift register 43 of all of the other image processors 41 shows zero drop for each of the two pixels from its processing target end portion. Here, the other image processors 41 are the image processors 41 whose comparison result is "NO MATCH."

Specifically, the CPU 31 instructs the comparator 45 of each of the other image processors 41 to determine whether or not the image data in the shift register 43 shows zero drop for each of the two pixels from its processing target end portion, and acquires the determination results. The CPU 31 thereby determines whether or not the image data in the shift register 43 of all the other image processors 41 shows zero drop for each of the two pixels from its processing target end portion.

When determining that the number of drops is zero for the two pixels in all of the other image processors 41 (Step S50: YES), in Step S60, the CPU 31 determines that the pixel at the reduction target position corresponding to the position of Y in the end-portion determination pattern is a pixel at the processing target end portion of the four-color image.

Figure 13:
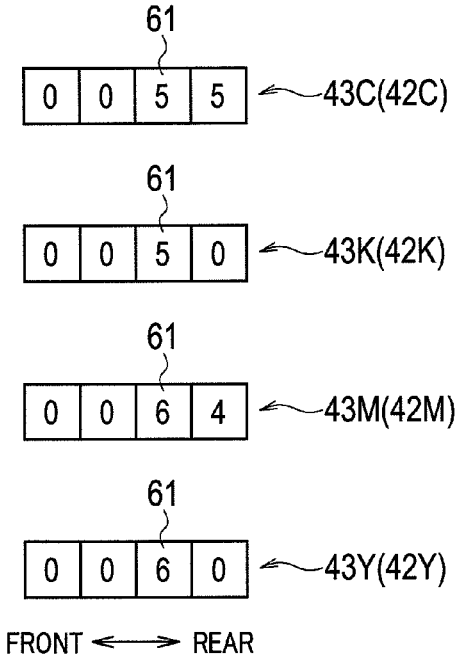
FIG. 13 is a diagram showing an example of image data in a shift register and a data buffer of each image processor.

For instance, assume that the processing target end portion is the front end portion and that image data shown in FIG. 13 are stored in the shift registers 43C, 43K, 43M, and 43Y and the data buffer 42C, 42K, 42M, and 42Y of the image processors 41C, 41K, 41M, and 41Y, respectively. In this case, the result of comparison with the end-portion determination pattern 51 is "MATCH" for the shift registers 43C and 43M. In the shift registers 43K and 43Y for which the result of comparison with the end-portion determination pattern 51 is "NO MATCH," the number of drops for the two front pixels is zero. Hence, pixel 61 at the reduction target position corresponding to the position of Y in the end-portion determination pattern 51 is determined as being a pixel at a front end portion of the four-color image.

Figure 14A:
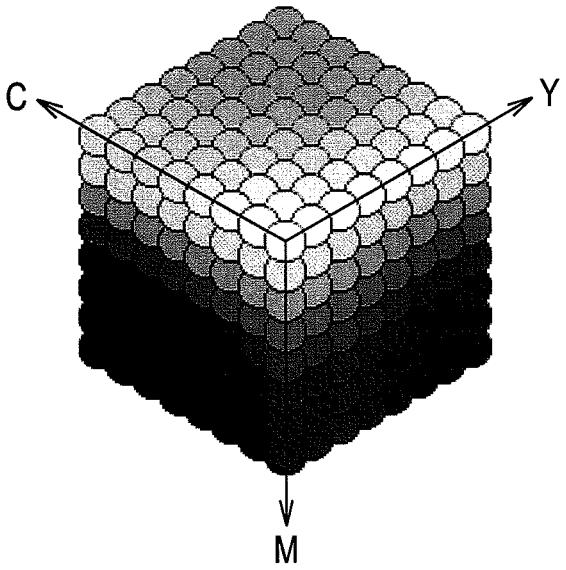
FIG. 14A is a diagram showing a three-dimensional color space represented by CMY of 0 to 7 drops.
Figure 14B:
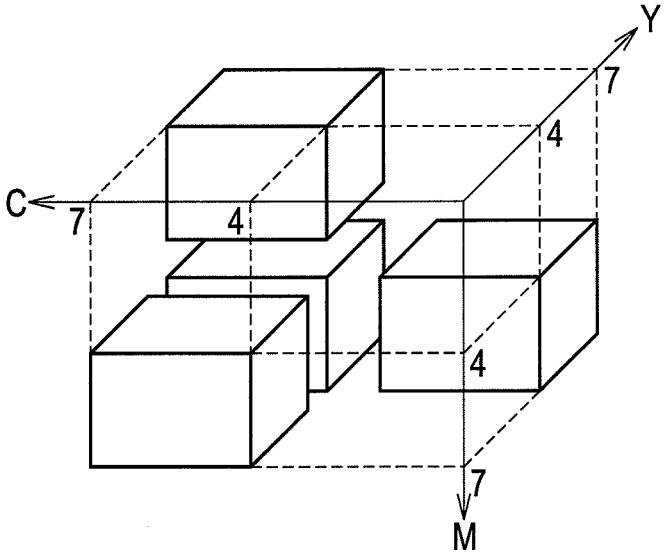
FIG. 14B is a diagram showing a range of a reduction target color in the color space in FIG. 14A.

Next, in Step S70, the CPU 31 determines whether or not the color of the pixel at the end portion of the image is a color targeted for reducing the amount of ink ejected (called a reduction target color below). Specifically, based on the number of drops of each of C, K, M, and Y for the pixel at the end portion of the image, the CPU 31 determines whether or not the color of the pixel is a reduction target color. For example, the CPU 31 determines that the color of the pixel at the end portion of the image is a reduction target color when the number of drops of each of C, M, and Y for the pixel at the end portion of the image is four to seven as shown with solid lines in FIG. 14B in a color space shown in FIG. 14A and also when the number of drops of K is four to seven. In this way, when the pixel at the end portion of the image is of a relatively dark color, the amount of ink ejected is reduced. In the example in FIG. 13, the number of drops of C, K, M, and Y is five, five, six, and six, respectively, and therefore the color of the pixel 61 is a reduction target color.

When determining that the color of the pixel at the end portion of the image is not a reduction target color (Step S70: NO), the CPU 31 proceeds the processing to Step S100 in FIG. 12.

When determining that the color of the pixel at the end portion of the image is a reduction target color (Step S70: YES), the CPU 31 reduces the amount of ink of a most protruding color ejected to the pixel at the reduction target position. The most protruding color is the color of the nozzle array 23 whose nozzle 24 protrudes (is displaced) toward the processing target end portion the most among the nozzles 24, of the respective nozzle arrays 23, used for the same ejection target pixel. For example, in the example shown in FIG. 4, when the processing target end portion is the front end portion, the nozzle 24*a*1 of the nozzle array 23C and the nozzle 24*a*3 of the nozzle array 23M protrude frontward the most. Hence, cyan (C) and magenta (M) are the most protruding colors. In the example shown in FIG. 7, cyan (C) is the most protruding color.

Specifically, the CPU 31 outputs an instruction to reduce the amount of ink ejected to the comparator 45 of the image processor 41 whose processing target color corresponds to the most protruding color. Upon receipt of the instruction to reduce the amount of ink ejected from the CPU 31, the comparator 45 instructs the multiplier 46 to multiply the number of drops for the pixel at the reduction target position of the image data in the data buffer 42, by the ejection amount reduction coefficient Kd and the nozzle positional relation coefficient Kp.

The ejection amount reduction coefficient Kd is a coefficient set in advance according to the number of drops (before the reduction) for a pixel at the reduction target position. For example, the ejection amount reduction coefficient Kd is set to 1 for one to three drops, 0.8 for four and five drops, and 0.7 for six and seven drops. The larger the number of drops, the smaller the ejection amount reduction coefficient Kd is. This is due to the following reason. The larger the number of drops, the larger the influence the positional displacement of the nozzle 24 has on the printing quality at an end portion of the image. Hence, the amount of ink ejected is reduced more when the number of drops is larger.

The nozzle positional relation coefficient Kp is a coefficient set in advance according to the displacement length Dm by which the nozzle 24 of a color protruding to the processing target end portion the most is displaced from the nozzle 24 of a second most protruding color. For instance, in the example in FIG. 4, when the processing target end portion is the front end portion, the displacement length Dm is P/2 which is the length of displacement of the nozzle 24*a*1 of the nozzle array 23C and the nozzle 24*a*3 of the nozzle array 23M from the nozzle 24*a*2 of the nozzle array 23K and the nozzle 24*a*4 of the nozzle array 23Y. In the example in FIG. 7, the displacement length Dm is the length of displacement of the nozzle 24*d*1 from the nozzle 24*d*3 in the main scanning direction. The displacement length Dm is measured in advance.

As described earlier, the CPU 31 determines that the nozzles 24, of the respective nozzle arrays 23, which are close to each other in the main scanning direction are used to eject ink to the same pixel, and therefore the maximum value of the displacement length Dm is P/2 (half pitch).

The nozzle positional relation coefficient Kp is set to gradually increase within a range of $0<Dm<P/2$: $Kp=1/Kd$ when the displacement length Dm is zero and $Kp=1$ when the displacement length Dm is P/2. When the displacement length Dm is zero, $Kd \times Kp=1$. Hence, the number of drops for the pixel at the reduction target position does not change even after the computation by the multiplier 46. When the displacement length Dm is P/2, $Kd \times Kp=Kd$.

As the number of drops after correction, the multiplier 46 sets the integer part of the result obtained by multiplying the number of drops for the pixel at the reduction target position by the ejection amount reduction coefficient Kd and the nozzle positional relation coefficient Kp. As to the pixels not targeted to reduce the amount of ink thereto, the multiplier 46 does not change (multiplies by 1) the number of drops. The image data obtained by the computation of the multiplier 46 is stored in the corrected-data buffer 47. After Step S80, the CPU 31 proceeds the processing to Step S100 in FIG. 12.

When determining in Step S50 that the image data in the shift register 43 of each of the other image processors 41 shows zero drop for any of the two pixels from the processing target end portion (Step S50: NO), in Step S90, the CPU 31 determines that the pixel is not at the end portion of the image. In this case, the CPU 31 does not output the instruction to reduce the amount of ink ejected, and therefore the multiplier 46 of each of the image processors 41 does not change (multiplies by 1) the number of drops for the pixels of the image data in the data buffer 42. After Step S90, the CPU 31 proceeds the processing to Step S100 in FIG. 12.

Figure 12:
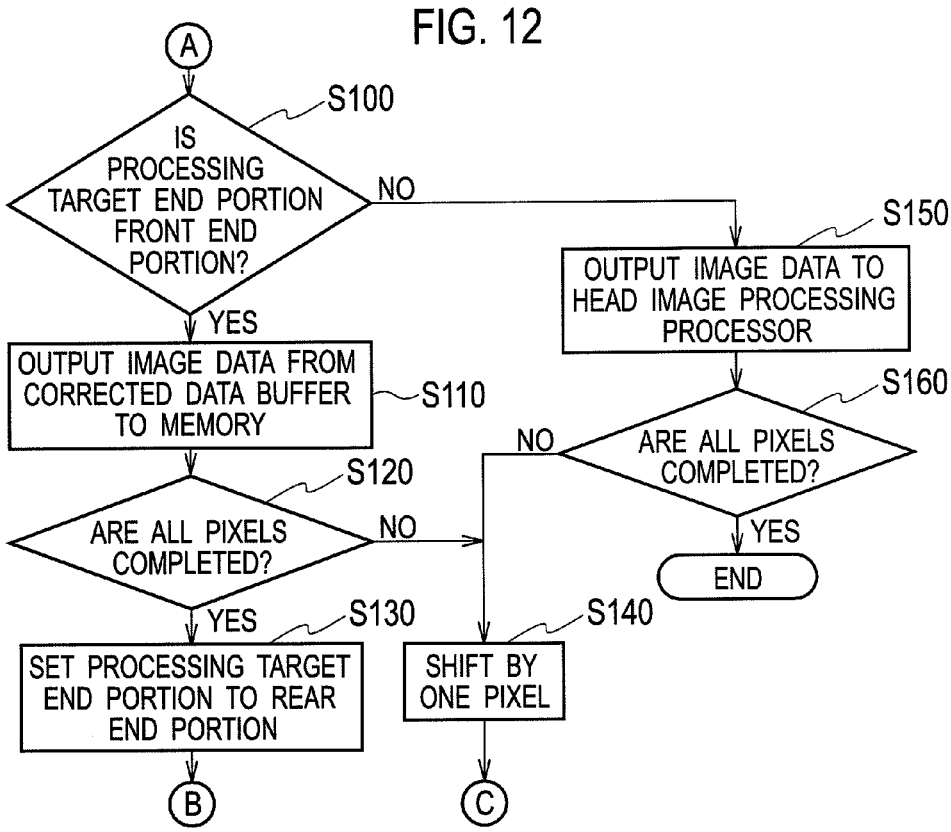
FIG. 12 is a flowchart of processing for correcting the amount of ink ejection.

In Step S100 in FIG. 12, the CPU 31 determines whether the current processing target end portion is the front end portion or not. When determining that the current processing target end portion is the front end portion (S100: YES), in Step S110, the CPU 31 outputs the four-pixel image data in the corrected-data buffer 47 to the memory 32. Thus, the image data the front end portion of which has been corrected is saved in the memory 32.

Next, in Step S120, the CPU 31 determines whether or not the correction processing for the front end portion has been completed for all the pixels of the image data to be printed.

When determining that the processing has been completed for all the pixels (Step S120: YES), in Step S130, the CPU 31 sets a rear end portion as the end portion targeted for the correction processing by each image processor 41. Thereby, the rear end-portion determination pattern 52 is set in the pattern retainer 44 of each image processor 41. Then, the CPU 31 returns the processing to Step S20 in FIG. 11 to execute the correction processing for the rear end portion. In the correction processing for the rear end portion, image data retrieved from the memory 32 is the image data the front end of which has been corrected.

When determining that the processing has not been completed for all the pixels (Step S120: NO), in Step S150, the CPU 31 shifts the image data to be saved in the data buffer 42 and the shift register 43 by one pixel. Thereafter, the CPU 31 returns the processing to Step S30 in FIG. 11.

When determining in Step S100 that the current processing target end portion is the rear end portion (S100: NO), in Step S150, the CPU 31 outputs the four-pixel image data in the corrected-data buffer 47 to the head image allocator 48.

Next, in Step S160, the CPU 31 determines whether or not the correction processing for the rear end portion has been completed for all the pixels of the image data to be printed. When determining that the processing has not been completed for all the pixels (Step S160: NO), the CPU 31 proceeds the processing to Step S140.

When determining that the processing has been completed for all the pixels (Step S160: YES), the CPU 31 ends the series of processing for correcting the amount of ink ejected.

The head image allocator 48 divides the image data the amounts of ejected ink for which has been corrected inputted by the corrected-data buffer 47 into appropriate pieces for the head modules 22 of the head blocks 21 and outputs them to the head modules 22. The nozzles 24 of each head module 22 eject ink to the sheet Pa conveyed by the conveyer 2 based on that image data, and thus the image is printed.

As described above, the head drive controller 34 reduces the amount of ink ejected (the number of drops) to the pixel at a front end portion of an image, the ink being ejected from the nozzle 24 protruding frontward the most among the nozzles 24, of the respective nozzle arrays 23, used for the same ejection target pixel. The head drive controller 34 also reduces the amount of ink ejected (the number of drops) to the pixel at a rear end portion of the image, the ink being ejected from the nozzle 24 protruding rearward the most among the nozzles 24, of the respective nozzle arrays 23, used for the same ejection target pixel. Thereby, a color tone change at the end portions, in the main scanning direction, of the image can be suppressed. As a result, lowering of the quality of printed image can be alleviated.

Figure 15:
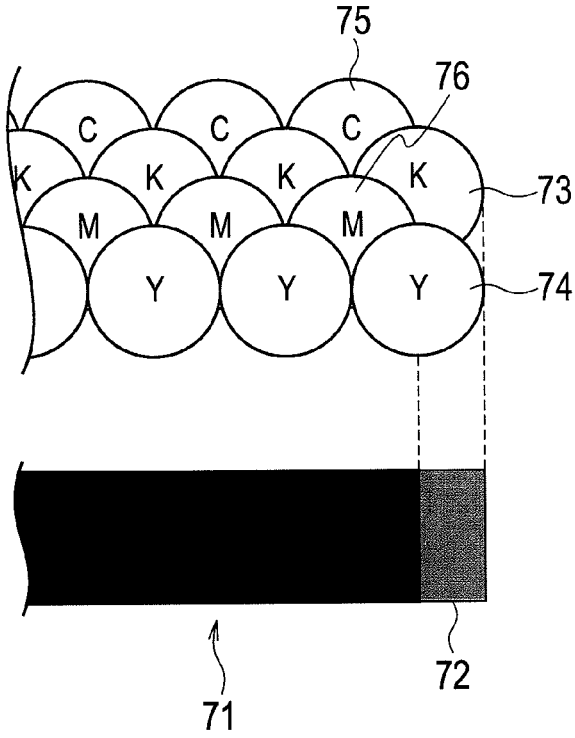
FIG. 15 is a diagram illustrating an example of a printed image conventionally obtained.

Here, in the example in FIG. 4, assume that the ejection target pixel of the nozzles 24*a*1 to 24*a*4 is a pixel at a rear end portion of an image, and that the nozzles 24 eject the same amount of ink in order to print an image which requires that the same amount of ink (the same number of drops) of all the colors be ejected to the pixel. In this case, as shown in FIG. 15, a contour portion 72 having a different color tone from other portions is generated at the rear end portion of a printed image 71. This contour portion 72 is generated by the rearward displacement of dots 73 and 74 of ink ejected respectively from the nozzles 24*a*2 and 24*a*4 protruding rearward the most among the nozzles 24*a*1 to 24*a*4 from dots 75 and 76 of ink ejected respectively from the nozzles 24*a*1 and 24*a*3. In FIG. 15, C, K, M, or Y in each dot indicates the color of the dot. Although the arrays of dots are displaced vertically in FIG. 15 for the purpose of illustration, they are actually ejected onto the same line.

Figure 16:
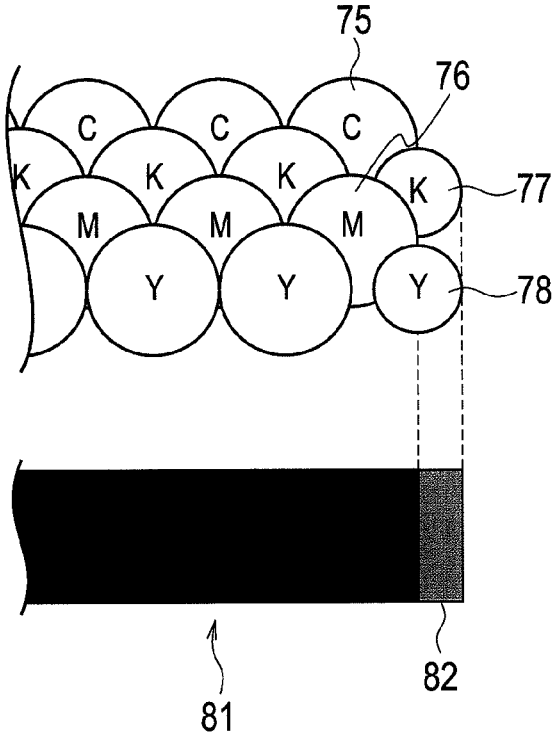
FIG. 16 is a diagram illustrating an example of a printed image obtained by the embodiment.

To reduce such a contour portion, in this embodiment, the amount of ink ejected from the nozzles 24*a*2 and 24*a*4 is reduced. Consequently, as shown in FIG. 16, dots 77 and 78 of ink ejected respectively from the nozzles 24*a*2 and 24*a*4 are smaller than the dots 75, 76, and so on. Thus, a contour portion 82 having a different color tone from other portions, which is generated at a rear end portion of a printed image 81, is smaller than the contour portion 72 in FIG. 15. As a result, according to the inkjet printer 1 of this embodiment, lowering of the quality of printed image can be alleviated.

In addition, in the inkjet printer 1, the ejection amount reduction coefficient Kp is used to control the level of the reduction in the amount of ink ejected, according to the amount of ink (before the reduction) to be ejected to the pixel at the reduction target position. By thus obtaining a reduction level appropriate for the amount of ink ejected, it is suppressed that an excessive change is made on the printed image.

Moreover, in the inkjet printer 1, the nozzle positional relation coefficient Kp is used to control the level of the reduction in the amount of ink ejected, according to the displacement length Dm by which the nozzle 24 (the nozzle array 23) of a color protruding toward the processing target end portion the most is displaced from the nozzle 24 (the nozzle array 23) of the second most protruding color. Thus, the level of the reduction in the amount of ink ejected can be adjusted appropriately according to the positional relation among the nozzle arrays 23.

Further, in the inkjet printer 1, the amount of ink ejected is controlled according to the color of a pixel at an end portion of an image. For example, when the color of a pixel at an end portion of an image is relatively dark and therefore is a reduction target color, the pixel is targeted for the reduction in the amount of ink ejected. When the color of a pixel at an end portion of an image is light, the contour portion 72 shown in FIG. 15 does not stand out. For this reason, when the color of a pixel at an end portion of an image is light, the amount of ink ejected is not reduced, to thereby allow simplification of the processing.

Although the inkjet head 4 used in the above embodiment has four nozzle arrays 23, the present invention is applicable as long as the inkjet head 4 has multiple nozzle arrays 23.

Further, in the above embodiment, a pixel at an end portion of an image is targeted for the reduction in the amount of ink ejected when the color of the pixel is a reduction target color. Alternatively, the level of the reduction in the amount of ink ejected may be controlled according to the color of the pixel at the end portion of the image.

Further, instead of changing the amount of ink ejected to a pixel at a front end portion of an image from the nozzle 24 protruding frontward the most among the nozzles 24, of the respective nozzle arrays 23, used for the same ejection target pixel, the amount of ink ejected to that pixel from the nozzles 24 of the other nozzle arrays 23 may be increased. However, when the amount of ink ejected to the pixel at the front end portion of the image from the nozzles 24 of the other nozzle arrays 23 is the maximum number of drops in the image data, the amount of ink ejected to the pixel at the front end portion of the image by the nozzle array 23 of the most protruding color is reduced, and the amount of ink ejected to that pixel from the other nozzle arrays 23 is not changed, as in the above embodiment. Similarly, instead of changing the amount of ink ejected to a pixel at a rear end portion of the image from the nozzle 24 protruding rearward the most among the nozzles 24, of the respective nozzle arrays 23, used for the same ejection target pixel, the amount of ink ejected to that pixel from the nozzles 24 of the other nozzle arrays 23 may be increased. However, when the amount of ink ejected to the pixel at the rear end portion of the image from the nozzles 24 of the other nozzle arrays 23 is the maximum number of drops in the image data, the amount of ink ejected to the pixel at the rear end portion of the image by the nozzle array 23 of the most protruding color is reduced, and the amount of ink ejected to that pixel from the other nozzle arrays 23 is not changed, as in the above embodiment. A color tone change at the end portions, in the main scanning direction, of the image can be suppressed in this way as well.

Although the amount of ink ejected is reduced by decreasing the number of drops of ink in the above embodiment, the amount of ink ejected may be reduced by changing the size of the drops.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. An inkjet printer comprising:

an inkjet head having a plurality of nozzle arrays each having a plurality of nozzles configured to eject ink, the nozzle arrays being configured to eject ink of different colors from one another; and a controller configured to control the inkjet head, wherein at least one of the plurality of nozzle arrays is arranged with the nozzles thereof displaced in position from the nozzles of the other nozzle arrays in an arrangement direction of the nozzles, the controller is configured to reduce an amount of ink to be ejected to a pixel at an end portion of an image on one side in the arrangement direction from a nozzle array of the plurality of nozzle arrays having a nozzle protruding to the one side the most among the nozzles of the nozzle arrays for a same ejection target pixel, and the controller is configured to reduce an amount of ink to be ejected to a pixel at an end portion of the image on the other side in the arrangement direction from a nozzle array of the plurality of nozzle arrays having a nozzle protruding to the other side the most among the nozzles of the nozzle arrays for a same ejection target pixel.

2. The inkjet printer according to claim 1, wherein the controller is configured to control a level of reduction in the amount of ink to be ejected, according to an original amount of ink to be ejected, before the reduction, to a pixel targeted for the reduction in the amount of ink to be ejected.

3. The inkjet printer according to claim 1, wherein the controller is configured to control a level of reduction in the amount of ink to be ejected to the pixel at the end portion of the image on the one side, according to a length by which the nozzle array of the plurality of nozzle arrays having the nozzle protruding to the one side the most among the nozzles of the nozzle arrays for the same ejection target pixel is displaced from a nozzle array of the plurality of nozzle arrays having the second-most protruding nozzle, and the controller is configured to control a level of reduction in the amount of ink to be ejected to the pixel at the end portion of the image on the other side, according to a length by which the nozzle array of the plurality of nozzle arrays having the nozzle protruding to the other side the most among the nozzles of the nozzle arrays for the same ejection target pixel is displaced from a nozzle array of the plurality of nozzle arrays having the second-most protruding nozzle.

4. The inkjet printer according to claim 1, wherein the controller is configured to control the amount of ink to be ejected, according to a color of the pixel at the end portion of the image on each of the one side and the other side.

5. An inkjet printer comprising:

an inkjet head having a plurality of nozzle arrays each having a plurality of nozzles configured to eject ink, the nozzle arrays being configured to eject ink of different colors from one another; and a controller configured to control the inkjet head, wherein at least one of the plurality of nozzle arrays is arranged with the nozzles thereof displaced in position from the nozzles of the other nozzle arrays in an arrangement direction of the nozzles, the controller is configured to increase an amount of ink to be ejected to a pixel at an end portion of an image on one side in the arrangement direction from nozzle arrays of the plurality of nozzle arrays other than a nozzle array having a nozzle protruding to the one side the most among the nozzles of the nozzle arrays for a same ejection target pixel, and the controller is configured to increase an amount of ink to be ejected to a pixel at an end portion of the image on the other side in the arrangement direction from nozzle arrays of the plurality of nozzle arrays other than a nozzle array having a nozzle protruding to the other side the most among the nozzles of the nozzle arrays for a same ejection target pixel.

* * * * *